US006637766B2

(12) United States Patent
Cuzzit et al.

(10) Patent No.: US 6,637,766 B2
(45) Date of Patent: Oct. 28, 2003

(54) ALPINE SKI

(75) Inventors: Daniel Cuzzit, La Murette (FR); Pierre Billon, Voiron (FR); Eric Restani, Voiron (FR); Thierry Schrobiltgen, Attignat-Oncin (FR); Milena Stefanova, St Barthelemy de Sechilienne (FR)

(73) Assignee: Skis Rossignol S.A., Voiron (FR)

( * ) Notice: Subject to any disclaimer, the term of this patent is extended or adjusted under 35 U.S.C. 154(b) by 0 days.

(21) Appl. No.: 09/832,796

(22) Filed: Apr. 12, 2001

(65) Prior Publication Data

US 2001/0035630 A1 Nov. 1, 2001

(30) Foreign Application Priority Data

Apr. 14, 2000 (FR) ..... 00 04877

(51) Int. Cl.[7] ..... A63C 5/07
(52) U.S. Cl. ..... 280/602; 280/608
(58) Field of Search ..... 280/602, 607, 280/608, 609, 610, 617

(56) References Cited

U.S. PATENT DOCUMENTS 5,096,217 A * 3/1992 Hunter ..... 280/607
5,232,241 A 8/1993 Knott et al.
5,427,400 A * 6/1995 Bejean ..... 280/610
5,435,588 A * 7/1995 Commier et al. ..... 280/602
5,671,940 A * 9/1997 Abondance ..... 280/602
5,803,478 A 9/1998 Gavalis
5,915,719 A * 6/1999 Bauvois ..... 280/607
6,315,317 B1 * 11/2001 Liard et al. ..... 280/607

FOREIGN PATENT DOCUMENTS

CH 671 887 A5 10/1989
FR 2 763 861 A 12/1998

* cited by examiner

*Primary Examiner*—Brian L. Johnson
*Assistant Examiner*—Brian L. Swenson
(74) *Attorney, Agent, or Firm*—Oliff & Berridge, PLC

(57) ABSTRACT

Alpine ski comprising a front area known as the tip area (2), a rear area known as the tail area (4), and an intermediate area known as the mid-section (3) designed to receive a stop (12) and a heelpiece (13) comprising the binding of the boot of a skier. In this ski, the rigidity, namely the resistance to flexing in the lengthwise direction of the ski, of the center part of the mid-section (3) is less than the rigidity in the two end parts of the mid-section (3), namely the parts that connect with the front (2) and rear (4) areas.

3 Claims, 4 Drawing Sheets

ALPINE SKI

FIELD OF THE INVENTION

The present invention relates to an Alpine ski. An Alpine ski has a front area known as the tip, a rear area known as the tail, and an intermediate area known as the mid-section.

BACKGROUND OF THE INVENTION

FIG. 1 of the schematic drawing attached is a profile view of an Alpine ski wherein the tip area, mid-section, and tail area are designated by reference numerals 2, 3, and 4. This FIG. 1 also shows that the thickness of the ski varies over its length, the thickness being substantially greater in the mid-section than in the end areas, namely the tip and tail areas. This is because the binding of the skier's boot is mounted in the mid-section area. Hence this area has to be the strongest, and it is through this mid-section that most of the forces between the snow and the skier's boot pass.

As a result of this design, the rigidity of the ski, i.e. the resistance to flexing, is not constant over the entire length of the ski. As shown in FIG. 2, which is a curve of the ski length on the abscissa axis plotted against the rigidity on the ordinate axis, the rigidity of the ski is far greater in the mid-section (P) than in the tip (S) and tail (T) areas. That fact that the binding is mounted in the mid-section, and that ski boots with very rigid soles are used, increases the rigidity still further relative to the rigidity of the ski considered alone. As a result, the difficulty in turning with the ski is increased.

The rigidity of a ski is measured as follows: the ski is placed flat between two supports with a distance of L (200 to 600 mm) between them and a load F of 40 to 60 kg is applied half-way between these supports. The deformation of the ski under this load (flex) is then measured. The ski is then moved so that this measurement can be made on another area (moved between 50 and 200 mm). The different flex values define the rigidity curve shown in FIG. 2.

To offset this rigidity added by the boot-binding assembly in the mid-section, the idea was evolved of mounting the binding, namely a stop and a heelpiece, not directly on the ski but on an intermediate plate attached locally to the ski, at one of its ends for example, and mounted with the possibility of sliding on the ski, allowing release. Such a plate is known from document CH 671,887. This release function effectively eliminates the influence of the tension springs of the heelpiece on the boot sole, increasing the bending of the ski, but nonetheless, because of its own rigidity, such a plate increases the rigidity of the ski. Making a plate to mount a boot binding that has notches favoring its flexing is also known. Such a plate is disclosed in document FR 2,763,861.

SUMMARY OF THE INVENTION

However, by returning flexibility to this plate, the concept of release became lost; moreover this solution requires the use of a plate that increases the weight of the ski-binding assembly.

The goal of the invention is to define the rigidity of a bare ski while anticipating the influence of the binding-boot assembly required for the ski to be used.

For this purpose, the Alpine ski to which it relates, the rigidity, namely the resistance to flexing in the lengthwise direction of the ski, of the center part of the mid-section is less than the rigidity in the two end parts of the mid-section, namely the parts that connect with the front and rear areas.

Hence, this ski is distinguished from a classical Alpine ski in which the rigidity curve, namely the resistance to flexing in the lengthwise direction of the ski placed flat between two supports, is practically a function of the change in thickness of the ski, namely the rigidity increases overall from the ends to the central area of the mid-section.

Advantageously, in the center part of the mid-section, the rigidity is at least 5% less than the lowest rigidity of the end parts of the mid-section.

The fact of reducing the rigidity in the center part of the mid-section enables the rigidity to be made uniform over the length of the mid-section, after taking into account the stiffening effect of the boot mounted inside the binding.

A number of solutions have been put into practice for decreasing rigidity with various ski designs: in the case of a traditional-design ski, namely having a lower assembly, strong longitudinal walls called sides, disposed on either side of a central core, and an upper assembly; in the case of a shell ski, i.e. a ski with an outer envelope made of synthetic material reinforced on the inside of the ski by at least one layer of stratified fabric, forming the upper wall and the side walls of the ski, and whose borders rest directly or indirectly on the edges; or in the case of a mixed-design ski, namely having a shell whose borders rest on lengthwise reinforcing elements, present at least in the center part or mid-section of the ski.

According to a first embodiment of this ski, in the case where it has lengthwise reinforcing elements visible on the side walls of the ski and called sides, the decrease in rigidity in the mid-section of the ski is achieved by a localized decrease in the height or the thickness of the sides.

In this case, the localized decrease in the height of the sides may be total, and may result in an interruption in the center part of the mid-section.

According to a second possibility, the decrease in rigidity in the center part of the mid-section is achieved by a localized reduction in the width of the upper part of the ski, with the lower part comprising the sole and the edges continuing to be of the traditional width.

According to a third possibility, the decreased rigidity in the center part of the mid-section is achieved by locally reducing the distance between the upper and/or lower reinforcements and the neutral fiber of the ski.

According to another possibility, the decreased rigidity in the center part of the mid-section is achieved by locally reducing the thickness of the ski.

According to one embodiment of the ski according to the invention, where its design comprises a shell made of synthetic material reinforced on the inside of the ski by at least one layer of stratified fabric, forming the upper wall and part of the side walls of the ski whose borders rest on lengthwise reinforcing elements visible on the side walls of the ski, and which rest directly or indirectly on the edges, the decrease in rigidity in the mid-section of the ski is achieved by reducing the height or locally suppressing the lengthwise reinforcing elements while increasing the height of the side walls of the shell in this area.

Whatever the ski design, the length of the reduced rigidity area is approximately 200 mm to 600 mm, preferably between 400 and 500 mm.

In any event, the invention will be properly understood from the description hereinbelow with reference to the attached schematic drawing showing several embodiments of this ski as nonlimiting examples.

DETAILED DESCRIPTION OF THE INVENTION

Figure 3:
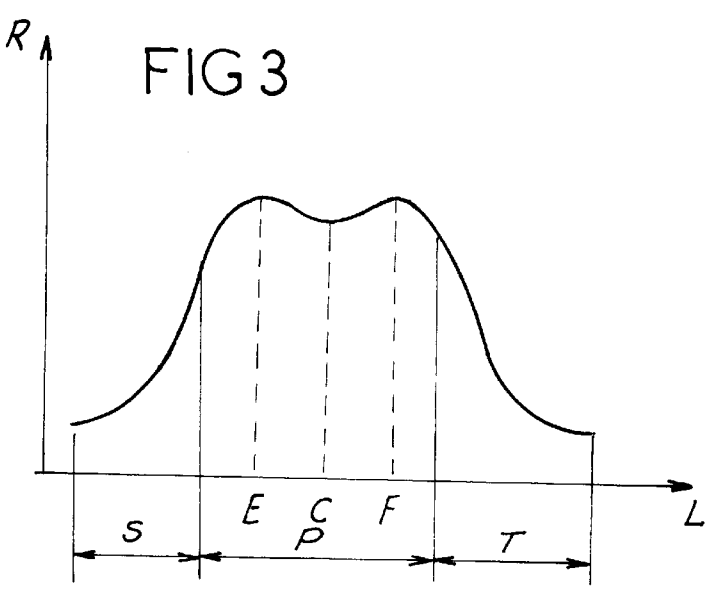
FIG. 3 is a view showing the change in rigidity of a ski according to the invention, over its length.
Figure 2:
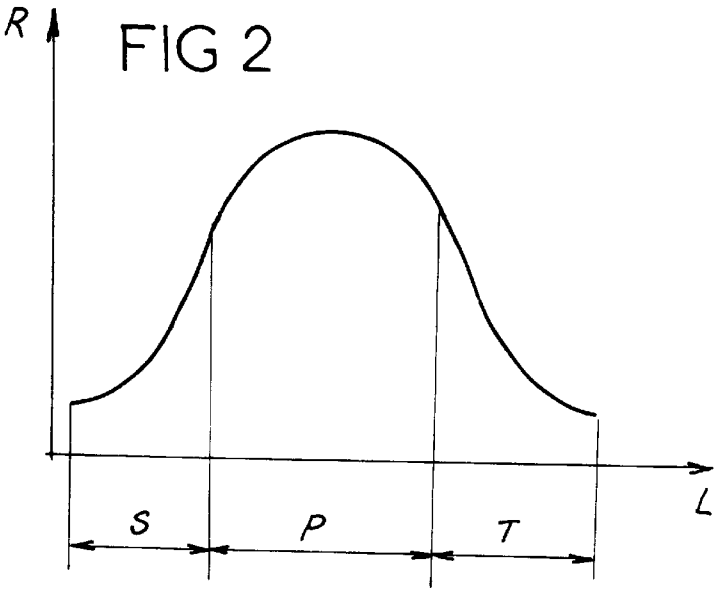
FIG. 2 is a view showing the change in rigidity of a traditional ski over its length.
Figure 1:
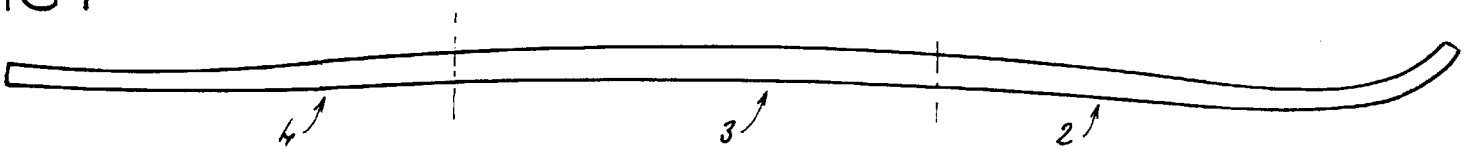
FIG. 1 is a profile view of an Alpine ski.

FIG. 3 shows the curve of the rigidity of a ski according to the invention wherein the length of the ski L is on the abscissa and the rigidity is on the ordinate axis. As shown in this curve, the rigidity in the center part C of mid-section P is less than the rigidity in the end parts E and F of the mid-section, namely the parts that connect with the tip S and tail T, respectively.

To achieve this result, several embodiments are presented below as examples.

Figure 4:
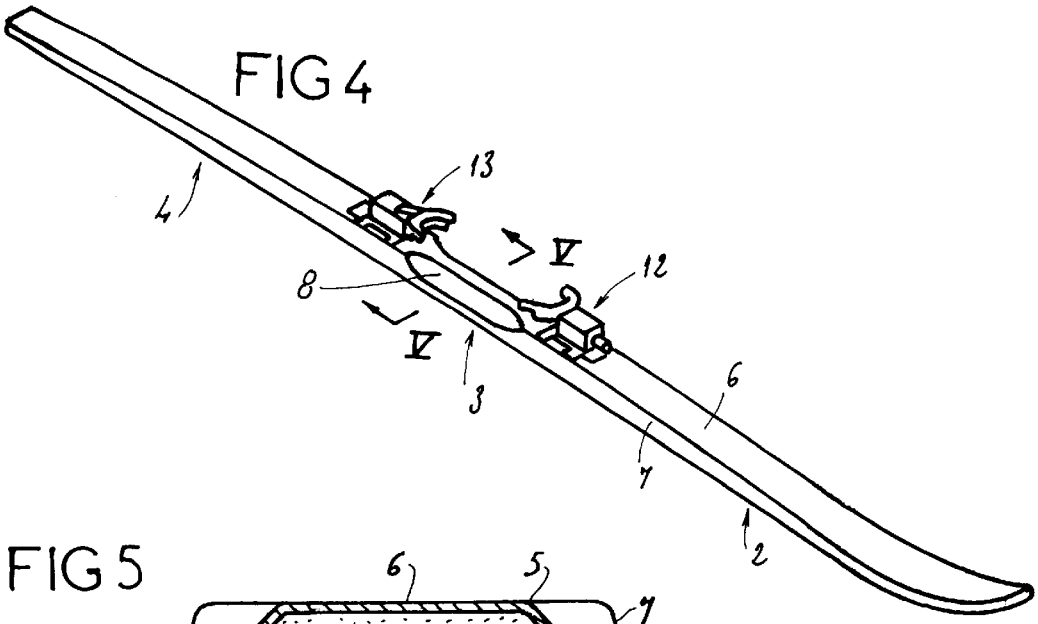
FIG. 4 is a perspective view of a first ski.
Figure 5:
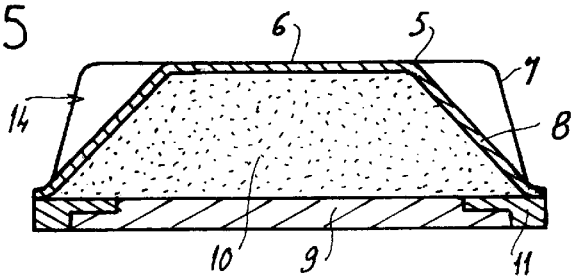
FIG. 5 is a schematic view in cross section on an enlarged scale along line V—V in FIG. 4.

FIGS. 4 and 5 represent a ski with a shell design, i.e. having a shell 5 made of synthetic material, reinforced inside the ski by at least one layer of stratified fabric, not shown in the drawing, forming an upper wall 6 and side walls 7, 8 of the ski, whose borders rest on edges 11. This ski has a lower assembly formed of a sliding sole 9 disposed between the edges, and a central core 10 resting on the lower assembly and forming the inside of the ski. Reinforcing elements are provided but not shown in the drawing as they do not concern the invention. As shown in FIG. 4, the center part of the mid-section serves to attach a stop 12 and heelpiece 13 on the upper face of the ski, these constituting the binding of a ski boot.

In the embodiment of the ski shown in FIGS. 4 and 5, the decrease in rigidity in the center part of the mid-section is achieved by locally reducing the width of the shell on either side of the median lengthwise axis of the ski. As shown in the drawing, this results in hollowed areas 14 obtained by increasing the inclination of the side walls 8 in this area relative to the side walls 7 of the ski over the rest of its length. FIGS. 4 and 5 show that, in the center part of the mid-section, the width of the upper area 6 is less.

Figure 6:
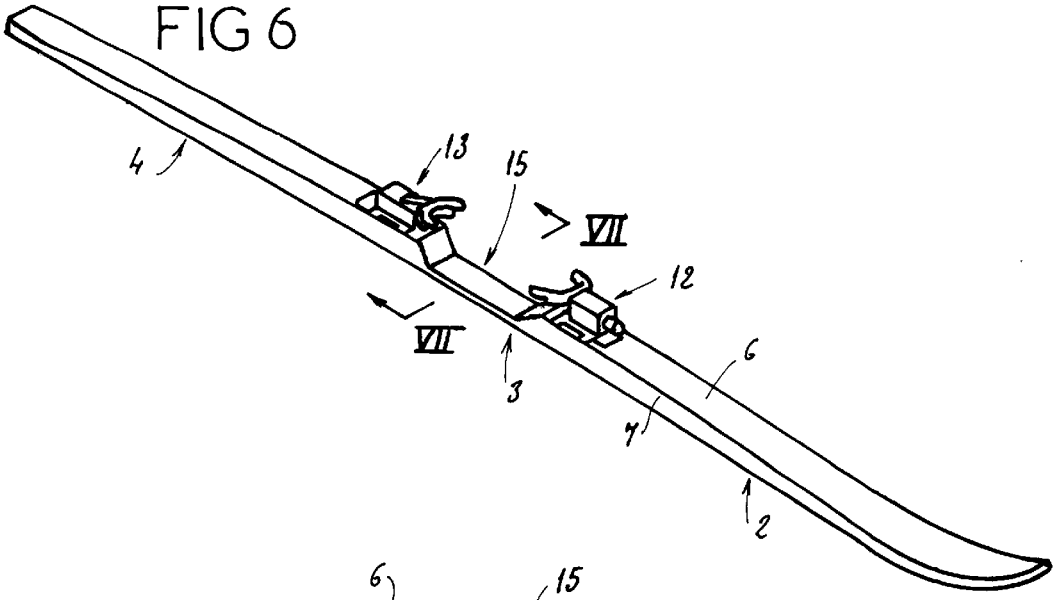
FIG. 6 is a perspective view of a second ski.
Figure 7:
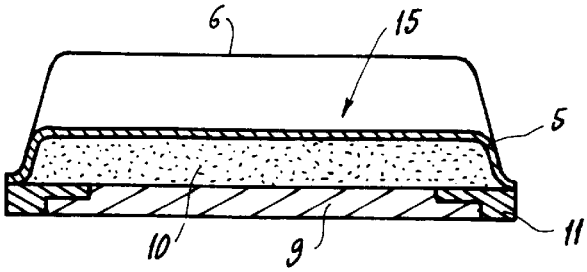
FIG. 7 is a schematic view in cross section on an enlarged scale of this ski along lien VII—VII in FIG. 6.

FIGS. 6 and 7 show a second ski, which is also a shell-design ski, having the same general features as the first ski. The same elements are accordingly designated by the same numerals as above.

In this second ski, the decreased rigidity of the center part of the mid-section is achieved by locally reducing the thickness of the ski in an area 15 located between stop 12 and heelpiece 13.

Figure 10:
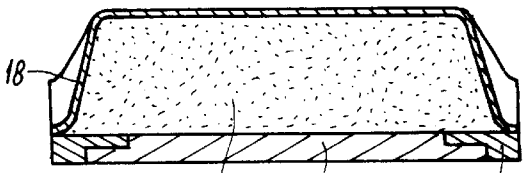
FIGS. 10 and 11 are two views in cross section on an enlarged scale of this ski along lines X—X and XI—XI, respectively, in FIG. 8.
Figure 8:
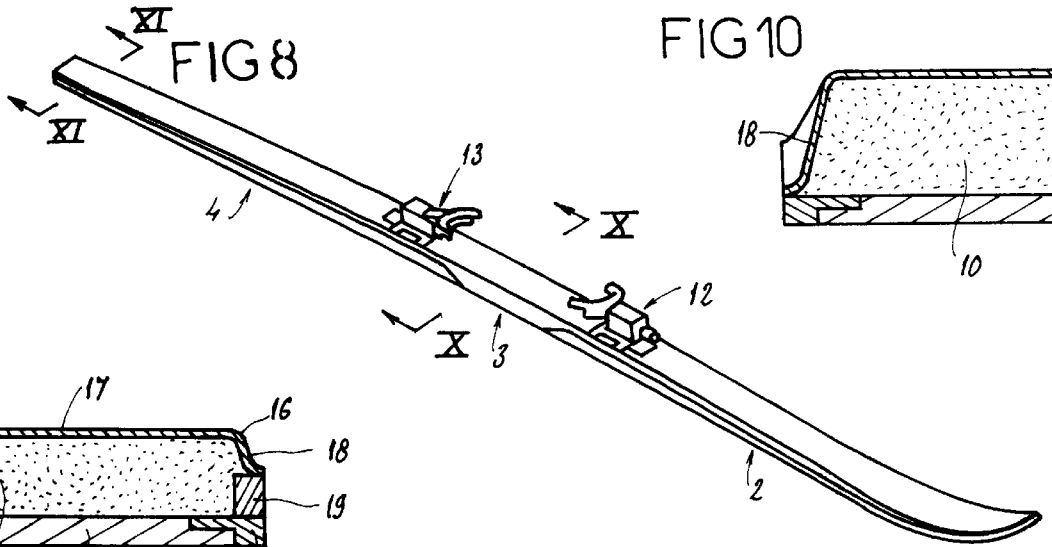
FIG. 8 is a perspective view of a third ski.
Figure 11:
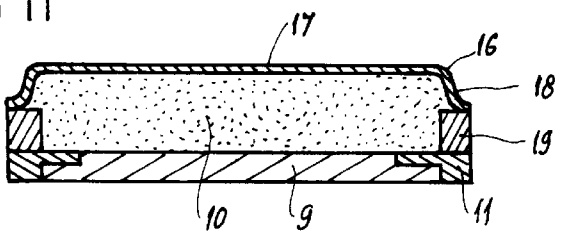
Figure 9:
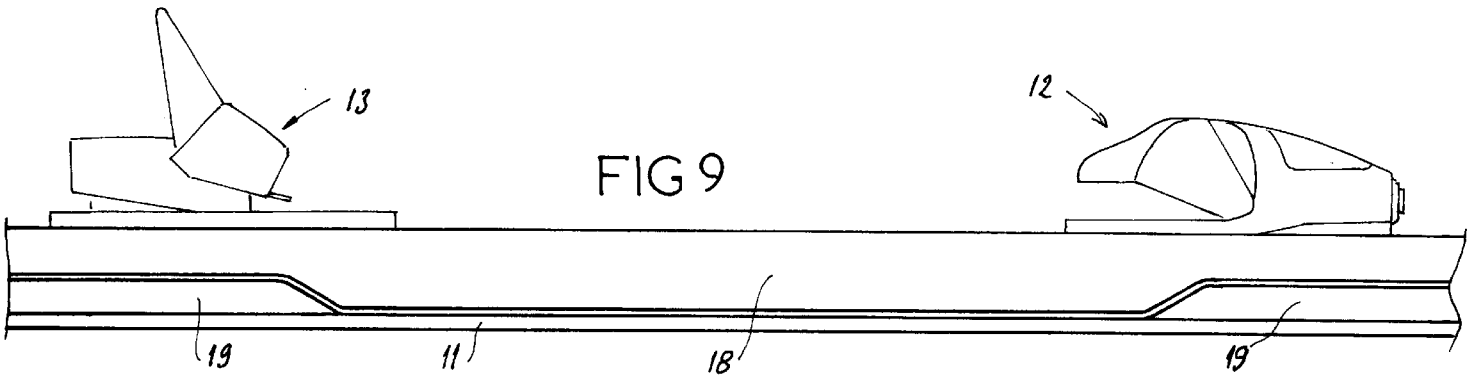
FIG. 9 is a side view on an enlarged scale of the center part of the mid-section of the ski in FIG. 8.

FIGS. 8 to 11 show a third embodiment of the ski according to the invention. In this ski, the same elements are designated by the same numerals as above. This ski has a shell 16 made of synthetic material, reinforced on the inside of the ski, namely on the core (1) side, by at least one layer of stratified fabric, not shown in the drawing. Shell 16 forms the upper wall 17 and part of side walls 18, and its borders rest on lengthwise reinforcing elements 19, visible on the side walls of the ski, which rest on edges 11. This design can clearly be seen from FIGS. 8 and 11. The decrease in rigidity in the center part of the mid-section of the ski is achieved by local elimination of the lengthwise reinforcing elements 19 while increasing the side walls 18 of the shell, as can be seen in FIGS. 8, 9, and 10. In the center part of the mid-section, the lower borders of shell 16 rest directly on the edges. In a variant of this ski, the height of the reinforcing elements would be reduced in the center part of the mid-section while not eliminating these elements altogether.

Figure 12:
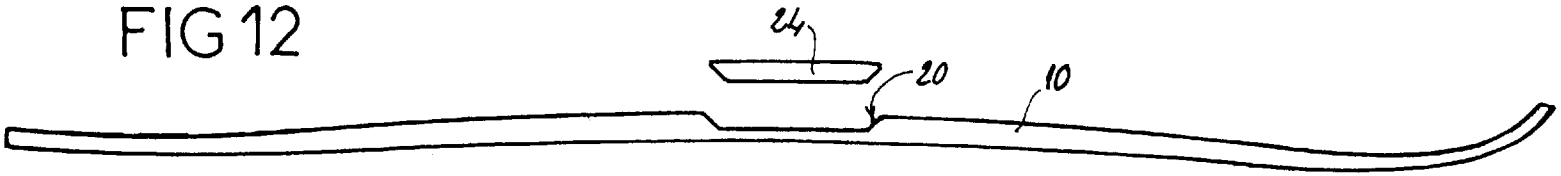
FIG. 12 is an exploded side view of a core of a fourth ski.

FIGS. 12 to 15 show another ski in which the same elements are designated by the same numerals as before. In this ski, core 10, in the center part of the mid-section, has a cavity 20. As shown in FIG. 12, a block 24 is provided to match the shape of cavity 20.

Figure 13:
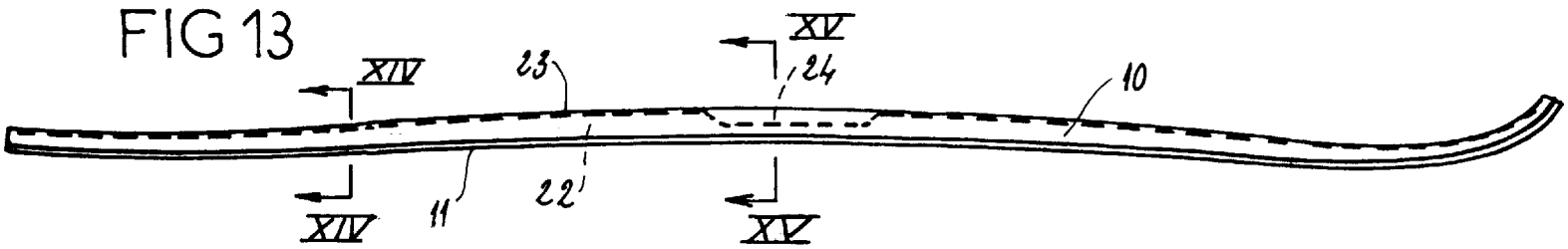
FIG. 13 is a side view of this ski in the mounted position.
Figure 15:
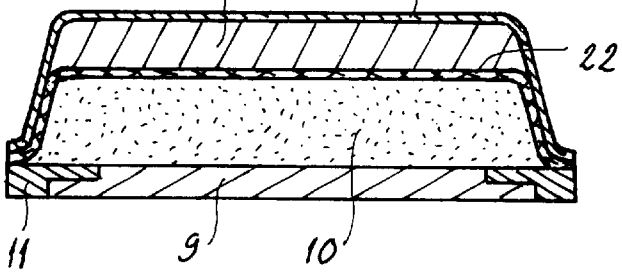
FIGS. 14 and 15 are two cross-sectional views along lines XIV—XIV and XV—XV of FIG. 13, respectively.
Figure 14:
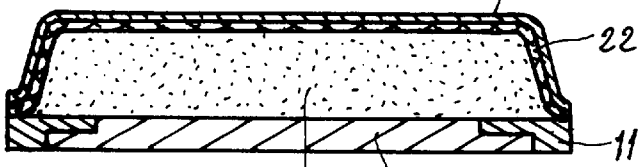

FIGS. 13 to 15 show schematically a ski according to the embodiment formed as follows: when sole 9, edges 11, and core 10 have been placed in a mold, a reinforcing fabric 22 is disposed such that it matches the shape of core 10 and hence of cavity 20, then block 24 is placed so that it fills cavity 20, and finally this assembly is capped by shell 23. This design reduces the rigidity of the ski in the center part of its mid-section. This decreased rigidity could be achieved in the variants by not using a cale, but having upper reinforcing element 22 or the lower reinforcing element, not shown, come close to the neutral fiber of the ski in the area in which the rigidity is to be reduced.

As shown by the foregoing, the invention greatly improves on existing technology by providing a ski whose design—design being construed in the broad sense and covering both an arrangement of materials and dimensions—makes the rigidity uniform in the center part of the mid-section without requiring complex means, and on the contrary, in certain embodiments, reduces the quantity of material and hence the weight and cost of the ski.

It goes without saying that the invention is not confined to the embodiments of this ski described as examples but on the contrary covers all variants. Thus, in particular, certain features of the ski which have been described in isolation could be combined, for example a reduction in width combined with a reduction in thickness, without thereby departing from the framework of the invention.

What is claimed is:

1. Alpine ski comprising a front tip area, a rear tail area, a top portion and a bottom portion connected by sides, an intermediate area providing a mid-section designed to receive a stop and a heelpiece comprising a binding of a boot of a skier, and a discontinuous lengthwise reinforcing element localized to the front tip area and the rear tail area, characterized in that rigidity in the lengthwise direction of the ski of a center part of the mid-section is less than rigidity in the front and rear areas of the mid-section, wherein the reduced rigidity in the mid-section of the ski is achieved by locally interrupting the reinforcing element in the mid-section of the ski.

2. Alpine ski according to claim 1, characterized in that the rigidity in the center part of the mid-section is at least 5% less than the lowest rigidity of the front and rear areas of the mid-section.

3. Alpine ski according to claim 1, characterized in that the length of the area of reduced rigidity is approximately 200 mm to 600 mm.

* * * * *